United States Patent [19]

Efner et al.

[11] Patent Number: 4,504,280

[45] Date of Patent: Mar. 12, 1985

[54] FUEL ADDITIVES FROM $SO_2$ TREATED MIXTURES OF AMIDES AND ESTERS DERIVED FROM VEGETABLE OIL, TALL OIL ACID, OR ARALKYL ACID

[75] Inventors: Howard F. Efner; Sidney Schiff, both of Bartlesville, Okla.

[73] Assignee: Phillips Petroleum Company, Bartlesville, Okla.

[21] Appl. No.: 625,338

[22] Filed: Jun. 27, 1984

Related U.S. Application Data

[63] Continuation-in-part of Ser. No. 524,008, Aug. 17, 1983.

[51] Int. Cl.[3] ..... C10L 1/24

[52] U.S. Cl. ..... 44/63; 44/71; 44/76; 260/401; 260/404.5

[58] Field of Search ..... 44/63, 71, 76; 252/51.5 A; 260/401, 404.5

[56] References Cited

U.S. PATENT DOCUMENTS

| | | | |
|---|---|---|---|
| 2,103,872 | 12/1937 | Schoeller et al. | 260/404.5 PA |
| 2,329,086 | 9/1943 | Robinson et al. | 260/401 |
| 2,345,632 | 4/1944 | Robinson et al. | 260/404.5 PA |
| 2,583,772 | 1/1952 | Gunderson | 260/401 |
| 3,752,657 | 8/1973 | Richardson | 44/78 |
| 4,173,456 | 11/1979 | Scheule et al. | 44/62 |
| 4,230,588 | 10/1980 | Bonazza et al. | 260/404.5 PA |
| 4,269,606 | 5/1981 | Bonazza et al. | 44/63 |
| 4,344,771 | 8/1982 | Bonazza et al. | 44/71 |

*Primary Examiner*—Y. Harris-Smith

*Attorney, Agent, or Firm*—A. W. Umphlett

[57] ABSTRACT

(1) Vegetable oils, particularly soybean oil (2) tall oil acid, or (3) aralkyl acids, particularly phenylstearic acid, are reacted with multiamines, particularly tetraethylenepentamine, to form a product mixture for subsequent reaction with $SO_2$ to produce a product mix that has good detergent properties in fuels.

48 Claims, No Drawings

FUEL ADDITIVES FROM $SO_2$ TREATED MIXTURES OF AMIDES AND ESTERS DERIVED FROM VEGETABLE OIL, TALL OIL ACID, OR ARALKYL ACID

This is a continuation-in-part application of co-pending application Ser. No. 524,008, filed Aug. 17, 1983.

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to fuel detergent additives for use in hydrocarbon fuel in internal combustion engines. In yet another aspect of the invention it relates to mixtures containing a plurality of different functional moieties combining to produce superior qualities for fuel detergents.

With the advent of pollution standards for automobile exhaust it became important that fuel additives not contain metal that tend to poison the catalyst in automotive engine exhaust converter systems. One of the better fuel and lubricant additives that was developed to replace additives containing metal was an acid-treated mixture of vegetable oil derived from amides and esters that was set out in U.S. Pat. No. 4,344,771. The product was particularly economically attractive because it was based on readily available vegetable oils.

It has now been found that by treating mixtures of vegetable oil derived amides and esters with compounds other than the acids set out in U.S. Pat. No. 4,344,771 that a fuel additive of equal or in some aspects better characteristics can be obtained. It has also been found that fatty acid sources such as vegetable oil acids, tall oil acid, and aralkyl acid which are also readily available can be substituted for the vegetable oil in the derivation of the amides useful in the invention.

It is therefore an object of this invention to provide additive mixtures for internal combustion engine fuels containing multiple detergent functionalities. It is another object of this invention to provide a method for producing detergent additives for internal combustion fuels. It is still another object of this invention to provide a detergent fuel composition combining a fuel detergent additive with a hydrocarbon suitable for use as fuel in an internal combustion engine.

Other aspects, objects and the various advantages of this invention will become apparent upon reading this specification and the appended claims.

STATEMENT OF THE INVENTION

A method is provided for producing a detergent additive for fuels combining multiple detergent functionalities in a product mixture by (1) reacting a vegetable oil or a fatty acid source such as vegetable oil acids, tall oil acid or aralkyl acid with multiamine to produce a product mixture that is (2) further reacted with sulfur dioxide ($SO_2$).

A product mixture suitable as a detergent additive for fuels is provided which is a composition of matter prepared by reacting $SO_2$ with a product mixture obtained from the reaction of vegetable oil, tall oil acid or aralkyl acid with multiamine.

In a further embodiment of the invention a method is provided for reducing engine deposits in an internal combustion engine comprising the addition of a detergent fuel additive package having as a component a detergent additive which is a composition of matter prepared by reacting $SO_2$ with a product mixture obtained from the reaction of vegetable oil and multiamine.

The vegetable oils may be selected from those commonly available such as cottonseed oil, peanut oil, soybean oil, corn oil, rapeseed oil, coconut oil, etc. These are mainly triglycerides of long-chain monocarboxylic acids such as lauric, myristic, stearic, palmitic, palmitoleic, oleic, linoleic, etc., i.e., acids containing 10–25 carbon atoms:

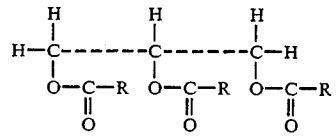

where R is an aliphatic radical of 10–25 carbon atoms.

Generally, vegetable oils contain glycerides of a number of acids, the number and kind varying with the source of vegetable for the oil.

A particularly useful and preferred acid mixture for reaction with polyamine in tall oil fatty acid obtained from tall oil. Tall oil is a mixture of rosin and fatty acids released by acidulation of the black liquor soap skimmed off the black liquor from the sulfate process in the manufacture of Kraft paper. Crude tall oil is commonly fractionally distilled to provide various cuts wherein the ratio of fatty acids to rosin acids varies from 1:99 to 99:1. In the context of this description tall oil fatty acid is intended to include tall oil compositions having a fatty acid content of at least about 50% by weight, the balance being mainly rosin acids in admixture with minor amounts of unsaponifiable materials of unknown chemical composition. The fatty acids in tall oil fatty acids consist mainly of oleic, linoleic, conjugated linoleic, palmitic, stearic, palmitoleic, arachidic and behenic acids. Tall oil fatty acids which are commercially available include those having fatty acid content in a range of about 50 to about 98 percent by weight with the total fatty acid content being divided into the following compositions: palmitic (0.1–5.3%); palmitoleic (0–2.1%); stearic (2.1–2.6%); oleic (39.3–49.5%); linoleic (38.1–45.1%); eicosanoic (0–1.9%); eicosadienoic (0–3.2%); eicosatrienoic (0–2.9%); and behenic (0–0.9%) acids, with the balance being rosin acids, unidentified acids and unsaponifiable materials.

The reaction of polyamine with tall oil acid is carried out by the addition of tall oil acid to polyamine in an amount so that the weight ratios fall within a range of 1:10 to 10:1, preferably 5:1 to 1:5. When the most preferred polyamine, tetraethylenepentamine (TEPA) is used a molar ratio of about 3:1 of tall oil acid to polyamine is used. A reaction temperature in the range of about 125° C. to about 190° C. under a pressure of 0.1 to 1 atm facilitates the removal of water with the reaction terminated when about one mole of water per mole of acid reactant is collected. Sparging the reaction mixture with an inert gas has also been found to be beneficial. The reaction is usually carried out in the absence of solvent.

Aralkyl acids that are suitable for use to synthesize the additive are those acids that can be prepared by alkylation of an aromatic hydrocarbon such as benzene, toluene, xylenes, or the like with an unsaturated fatty acid such as the mono-unsaturated acids lauroleic, myristoleic, palmitoleic, oleic, gadoleic, and the like, or with poly-unsaturated fatty acids such as linoleic, linolenic, or moroctic acids—$C_{18}$ acids having two, three, and four double bonds, respectively. The aralkyl radical R of the acids (RCOOH) can contain from about 11–41 carbon atoms; preferably it will contain 17–29 carbon atoms. Examples of suitable aralkyl acids are diphenyllauric acid, triphenylpalmitic acid, phenylstearic acid, and the like in which at least one aromatic radical is combined in the original fatty acid.

The ratio in which aralkyl acid and polyamine are combined for reaction is about 0.2–1.0 moles of acid per equivalent of nitrogen. Preferably the ratio is between about 0.4–0.8 moles of acid per equivalent of nitrogen.

Production of amides by reaction between aralkyl acids and polyamines is accompanied by the liberation of water, and is facilitated by the use of temperatures above the normal boiling point of water. Reaction can be effected without using a solvent by operating under conditions in which water vapor is removed from the reactants with the aid of a stream of gas, preferably inert, such as nitrogen or argon. Alternatively the reaction can be effected in a solvent such as a hydrocarbon that permits operation under reflux at a temperature of about 100°–200° C. Since one mole of water is produced per mole of amide, measurement of evolved water provides a convenient method to follow the extent of the reaction.

Among the multiamines that are suitable for use in this invention are those having the general formula $H_2N(CH_2CH_2NH)_xH$ where x is an integer between 1–10, preferably 3–6. Representative multiamines are ethylenediamine (EDA), tetraethylenepentamine (TEPA), pentaethylenehexamine (PEHA), etc. Mixtures of multiamines may be used. Polyethylenimine, among the amines preferred for use in this invention, is representative of a more complex group of multiamines. The preferred multiamine for use in this invention is TEPA.

The amounts of vegetable oil and multiamine employed can be expressed in terms of the molar ratio of triglyceride to nitrogen. Broadly, the ratio is from about 0.05:1 to 1.00:1 and preferably is from about 0.13:1 to about 0.80:1.

The first reaction, which is between the oil and a multiamine, results in a product that is a mixture of glycerol, glycerol partly esterified (mono and diglycerides), and amides and imidazolines of the fatty acids, e.g.,

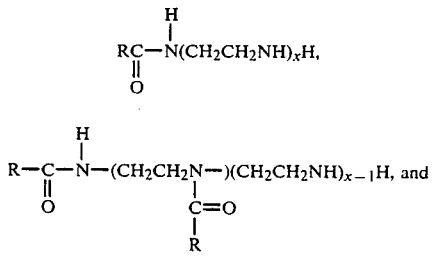

-continued

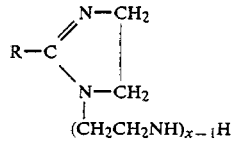

wherein x is as defined above. Reaction conditions for the first reaction are: temperature within the range of about 35° C. to about 260° C., preferably from about 120° C. to about 200° C., for a time of about 1 to about 16 hours, preferably about 4 to about 9 hours which can be carried out at atmospheric pressure, but is generally conducted at 15–65 psia when no diluent is present. If a diluent is employed the pressure is usually that produced by the vapor pressure of the diluent at the temperature employed. It is also preferable to utilize an inert atmosphere such as nitrogen over the reaction mixture.

The reaction of $SO_2$ with the product of the first reaction—to incorporate 0.1 to 1, preferably 0.1 to 1, mol. $SO_2$ per mole unreacted N—can be carried out with a reaction mixture in the same diluent within which it was produced. Normally liquid hydrocarbon diluents can be utilized in either the first or second reactions or both. It is also possible to strip the diluent from the products of the first and second reaction and replace it with a different diluent. Hydrocarbon diluents useful in the above reaction can include aromatic hydrocarbons of 6 to about 10 carbon atoms per molecule such as benzene, toluene, the xylenes, or mixtures thereof. Lube stocks such as solvent refined paraffinic oils or distillates such as kerosene can also be used as diluents. Such hydrocarbon diluents, if employed, need not be separated from the final product but can serve as solvent or carrier for the detergent additive to provide a convenient method of handling the additive when blending with fuel or lubricant stocks.

The treatment of products of the first reaction with $SO_2$ is accomplished by slowly bubbling $SO_2$ through the diluted first reaction products using rapid agitation to assure the best contact of the components. After completion of the $SO_2$ addition the product mixture of the second reaction can be used without water removal or can be heated to remove water as an azeotrope or by a sparging operation.

The final product is quite complex and the distribution of possible reaction products depends upon the ratio of vegetable oil to multiamine. This product is a detergent additive which is used at about 1–100 pounds/1,000 barrels of fuel to prevent harmful carburetor and intake system deposits. The fuel can be any hydrocarbon useful as an internal combustion engine fuel, preferably hydrocarbon mixtures used in commercial fuel blends.

As noted above, it is convenient to handle the detergent additive in a solvent, i.e., a carrier or vehicle, to provide an additive package for use in blending the additive with fuels or lubricant stocks. It is generally considered beneficial to include a minor amount of material which has demulsifier properties in the additive package in the present invention. Such a component, though preferred, is not essential to the deposit inhibiting effect of the additives in the present invention. Any material which is compatible with motor fuels and which exhibits demulsification properties when utilized at relatively low levels such as 0.1–10, preferably 0.5–5, percent by weight based on the weight of the additive in the additive package can be used. Due to the low dosage of such material, it has no tendency to interfere with the deposit-inhibiting effect of the additive or the combustion characteristics of the motor fuel.

Since carburetor detergents possess surfactant properties, fuels containing them often form undesirable emulsions when agitated in the presence of water. The Water Tolerance Test measures the amount of demulsifier which must be added in the additive-fuel blend to break the emulsion. Illustrative of demulsifying agents suitable for use in the present invention, but not limited thereto, are the oxyalkylated alkyl phenol formaldehyde polymers as disclosed in U.S. Pat. Nos. 2,499,367, 3,424,565, and 3,752,657. The most preferred of these is a commercially available product Oronite OGA-473. The testing of samples of an additive composition containing a fuel additive of the present invention, Oronite OGA-473 and kerosene as solvent was found to undergo phase separation on standing. It was found, however, that the addition of a coupling agent such as isopropyl alcohol in an amount of 5 to about 15 weight percent of the total composition provided a detergent additive package having adequate water tolerance and compatibility.

In the following examples, which should be taken as illustrative and not exclusive, the fuel detergent properties of the additive of the present invention will be made evident by results of various standard tests.

EXAMPLE I

Samples were prepared for the materials detailed below using the following reaction conditions:

Equal molar quantities of soybean oil and tetraethylenepentamine (TEPA) were heated to about 175° C. under nitrogen for 8 hours.

536 grams of this product was added to 200 mL of toluene. This was rapidly stirred while 32 grams of $SO_2$ (one molar equivalent) were slowly bubbled into the solution. After completion of the $SO_2$ addition the mixture was heated to remove water as an azeotrope. Solvent was then removed in a rotary evaporator at 90° C. The product contained 1.25 weight percent sulfur.

EXAMPLE II

Samples of the material produced above along with samples of fuel additives produced from acid-treated mixtures of vegetable oil derived amides and esters as set out in U.S. Pat. No. 4,344,771 were subjected to the "Falcon Engine Test". In this test, the inventive additive was added to the hydrocarbon fuel in the amount of 4 or 10 pounds of additive per thousand barrels of hydrocarbon fuel. The additive containing acid oil (the material described in U.S. Pat. No. 4,344,771) was tested at 25 pounds/thousand barrels of hydrocarbon fuel. In the "Falcon Engine Test" a premium base unleaded gasoline without additive, as a control of the various additives for test purposes was used to power a 170 CID 6-cylinder Falcon engine. The engine was run for 23 hours at 1800 rpm and 11.4 bhp with continuous, noncyclic operation. About 0.5 cubic feet per minute ambient air was introduced through PCV valve below the carburetor and 3.2 cubic feet per minute of exhaust gas was circulated unfiltered through the carburetor throttle board. Intake air was filtered through the standard filter element. An SAE 10W-40 motor oil was used with the oil sump temperature maintained at 216° plus or minus 4° F. The temperature of coolant out was maintained at 196° plus or minus 5° F. and the intake air temperature was varied to control the temperature above the carburetor sleeve at 150° plus or minus 2° F. The fuel flow was maintained at about 1.5 gallons per hour with the air/fuel ratio checked periodically but not controlled and the intake manifold vacuum recorded but not controlled. The performance of a fuel or additive in this test was evaluated on the basis of deposits formed on a removable aluminum sleeve in the carburetor throat. Three or four differential weights were obtained between the weight of the sleeve at the start of the test and the weights after the test: (1) unwashed, and (2) n-heptane washed. Visual ratings of deposits were not used in the evaluation. The results of the evaluation of the control and test runs are tabulated below.

TABLE I

FALCON ENGINE TEST

| Detergent | Treatment Rate | Percent Reduction and Deposits |
|---|---|---|
| Phil-Ad CD 40-5[1] | 25 PTB | 85 |
| Soya/TEPA/.5 $SO_2$ | 4 PTB | 85 |
| Soya/TEPA/$SO_2$ | 10 PTB | 93 |

[1]Commercial detergent additive produced by Phillips Petroleum Company from acid-treated mixtures of vegetable oil derived amides and esters by the process of U.S. Pat. No. 4,344,771

The data above show the performance of the $SO_2$-treated mixtures of vegetable oil derived amides and esters to give superior results in the Falcon Engine Test as compared to the well-known commercial product.

EXAMPLE III

In this example SOYA/TEPA/$SO_2$ prepared as in Example I, except that there was no removal of water after $SO_2$ addition, was tested as a component of a detergent package. The list of components of the test packages and the results of compatibility studies are shown in Table II below.

TABLE II

| Package Components | Component Function | Weight Percent of Components in Package | |
|---|---|---|---|
| SOYA/TEPA/$SO_2$ | Detergency | 40.0 | 40.0 |
| Union Camp D-78[a] | Corr. Inhib. | 3.0 | 3.0 |
| Oronite OGA-473[b] | Demulsification | 0.2 | 0.2 |
| Kerosene | Solvent | 56.8 | 46.8 |
| Iso-$C_3$ Alcohol | Coupling Agent | | 10.0 |
| Compatibility, ml/100 ml | | Phase | |
| Room Temp. | | Separation[c] | 0 |
| −20° F. | | — | 0 |
| 110° F. | | — | <.5 |
| NACE Corrosion[d], % Rust | | — | |
| @ 10 ptb Active | | | <5 |
| @ 4 20 ptb Active | | | 0 |
| Water Tolerance[e], Interf./$H_2O$/Sepr. | | — | |
| @ 10 ptb Active | | | 1/0/1 |
| @ 20 ptb Active | | | 1/0/1 |

[a]Mixture of polymerized fatty acids, i.e., dimer acids, trimer acids, etc.
[b]Methylene bridged ethoxylated phenol from Chevron Chemical Co.
[c]No further testing since phase separation encountered.
[d]Modified ASTM D665
[e]ASTM D1094

The data above show that even though phase separation was encountered using SOYA/TEPA/$SO_2$ with a corrosion inhibitor, demulsifier, and solvent, the addition of a small amount of coupling agent produced a package that did not separate and that passed both corrosion and water tolerance tests.

EXAMPLE IV

Preparation of 3 TOA/TEPA/$SO_2$

A 5 liter flask was charged with 2975.3 g. (10.5 mole) (Unitol ACD special*) and 666.8 g. (3.5 mole) tetraethylenepentamine (TEPA). This was stirred under a nitrogen atmosphere and heated. At about 135° C. water formation was evident. A nitrogen sparge was used to strip off this water as heating continued up to 190° C. A total of 181 mL $H_2O$ (theoretical $H_2O$=190.8) was collected in a Dean-Stark trap. This product was called 3 TOA/TEPA.

*Low rosin (1%) tall oil fatty acid (TOA) manufactured by Union Camp, Jacksonville, Fla. having a typical analysis of:

Total Fatty Acids, wt. %: 97.5
- Palmitic and Stearic Acids: 1.6
- Oleic Acid: 49.5
- Linoleic acid: 45.1
- Misc. Acids: 1.1

Rosin Acids: 1.0

Unsaponifiables: 1.5

A 1500 mL reactor was charged with 1020 g (about 1 mole) of the TOA/TEPA product. To this stirred mixture 64 g (1 mole) anhydrous $SO_2$ was introduced under the liquid surface at a rate such that the $SO_2$ did not escape the liquid. Over the period of $SO_2$ addition (1½ hr) the temperature rose to 66° C. The product was a brown viscous liquid called 3 TOA/TEPA/$SO_2$.

EXAMPLE V

Preparation of 3TOA/TEPA/$SO_2$/50% Kerosine

A 1500 mL reactor was charged with 510 g (about ½ mole) 3 TOA/TEPA and 542 g kerosine. To this stirred mixture 32 g (½ mole) $SO_2$ was introduced under the liquid surface over a 30 minute period. The temperature rose to 30° C. during this time. This product was less viscous than the product of Example IV due to the kerosine solvent.

EXAMPLE VI

Preparation of 3.5 TOA/E-100/1.2 $SO_2$/50% Kerosine

A 3 liter round bottom resin flask with a mechanical stirrer was charged under a nitrogen atmosphere with 189 g E-100 (Dow Chemical, ethyleneamine, $NH_2[C_2H_4NH]_nC_2H_4NH_2$), 885 g tall oil fatty acid (same as in example 1) and 1084 g kerosine. The reaction mixture was stirred and heated. At about 145° C. a water/kerosine azeotrope was collected in a Dean-Stark trap. The reaction mixture was heated to 199° C. over a 4 hr. period and about 50 mL $H_2O$ (54 mL theoretical) was recovered. After the reaction mixture cooled to room temperature, 64 g (1 mole) of anhydrous $SO_2$ was bubbled into the stirred product over a period of 1½ hours. The temperature rose to 33° C. This product was called 3.5 TOA/E-100/1.2 $SO_2$/50% kerosine.

EXAMPLE VII

Falcon Engine Test

An additive package was prepared by addition of kerosine to the product of Example VI. This was tested for detergency in gasoline in a Falcon engine test as in Example II. The results are shown in the table below.

TABLE III

FALCON ENGINE TEST

| Additive | conc. (ptb)* | % reduction of carburetor deposits |
|---|---|---|
| 3.5 TOA/E-100/1.2 $SO_2$ (product of Example VI) | 5 | 37.6 (ave. of 2 tests) |

*pounds of 3.5 TOA/E-100/1.2 $SO_2$ per 1000 barrels of gasoline.

Kansas City Premium Pipeline Base Gasoline was used in this test. These results demonstrate that the inventive product functions as a gasoline carburetor detergent.

EXAMPLE VIII

Preparation of 3PS/TEPA/$SO_2$

In a 12 liter flask a mixture of 3530.2 g (9.50 mole) phenylstearic acid (PS1) and 598.8 g (3.17 mole) tetraethylenepentamine (TEPA) was stirred while nitrogen bubbled through the liquid mixture. This was heated to 199° C. until 165.5 mL $H_2O$ was collected in a Dean-Stark trap (theoretical $H_2O$=171 mL).

The temperature was then reduced to 126° C., and 202.8 g $SO_2$ was bubbled in with stirring at a rate of 1.6 cubic feet per hr. The temperature decreased to 120° C. upon completion of the $SO_2$ addition. Then nitrogen was bubbled through the mixture and the temperature was raised to 142° C. for 4 hr to strip off 48 mL $H_2O$. This product is called 3PS/TEPA/$SO_2$.

We claim:

1. A composition useful as a detergent additive composition useful in the treatment of fuels comprising: reacting multiamine with compounds chosen from the group consisting essentially of (1) tall oil acid, (2) phenylstearic acid and (3) vegetable oil to obtain a first product mixture, said vegetable oil selected from among triglycerides of long-chain monocarboxylic acids of the formula

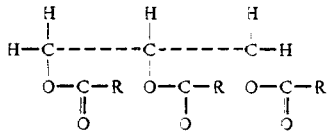

where R is an aliphatic radical of about 10 to about 25 carbon atoms, said first product mixture further reacted with $SO_2$ to obtain a second product mixture.

2. A composition of claim 1 useful as a detergent additive for fuels comprising the reaction product prepared by reacting multiamine with vegetable oil to obtain a first product mixture, said vegetable oil selected from among triglycerides of long-chain monocarboxylic acids of the formula

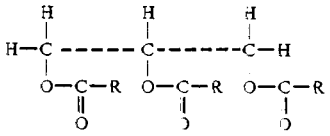

where R is an aliphatic radical of about 10 to about 25 carbon atoms, said first product mixture further reacted with $SO_2$ to obtain a second product mixture.

3. A composition of claim 2 wherein the multiamines have the general formula $H_2N(CH_2CH_2NH)_xH$ where x is an integer between 1 and 10.

4. The composition of claim 2 wherein said vegetable oils are selected from among the group consisting of cottonseed oil, peanut oil, soybean oil, corn oil, rapeseed oil, and coconut oil.

5. A composition of claim 3 wherein the vegetable oil is soybean oil.

6. A composition of claim 5 wherein the multiamine is tetraethylenepentamine.

7. A method for producing a detergent additive composition useful in the treatment of fuels comprising: reacting multiamine with compounds chosen from the group consisting essentially of (1) tall oil acid, (2) phenylstearic acid and (3) vegetable oil to obtain a first product mixture, said vegetable oil selected from among triglycerides of long-chain monocarboxylic acids of the formula

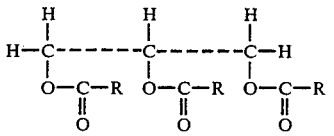

where R is an aliphatic radical of about 10 to about 25 carbon atoms, said first product mixture further reacted with $SO_2$ to obtain a second product mixture.

8. A method of claim 7 for producing a detergent additive composition useful in the treatment of fuels comprising: reacting multiamine with vegetable oil to obtain a first product mixture, said vegetable oil selected from among triglycerides of long-chain monocarboxylic acids of the formula

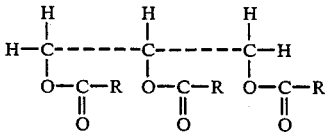

wherein R is an aliphatic radical of about 10 to about 25 carbon atoms, further reacting said first product mixture with $SO_2$ to obtain a second product mixture.

9. A method of claim 8 wherein the multiamines have the general formula $H_2N(CH_2CH_2NH)_xH$ where x is an integer between 1 and 10.

10. A method of claim 8 wherein said vegetable oils are selected from among the group consisting of cottonseed oil, peanut oil, soybean oil, corn oil, rapeseed oil, and coconut oil.

11. A method of claim 9 wherein said vegetable oil is soybean oil.

12. A method of claim 11 wherein the multiamine is tetraethylenepentamine.

13. A method for reducing engine deposits in an internal combustion engine comprising the addition of a detergent fuel additive package comprising the composition of claim 2 to a hydrocarbon fuel for the engine, said fuel detergent being added in an amount effective to reduce deposits and using said hydrocarbon fuel with fuel detergent additive as fuel in an internal combustion engine.

14. A method for reducing engine deposits in an internal combustion engine comprising the addition of a detergent fuel additive package comprising the detergent additive prepared by the method of claim 8 to a hydrocarbon fuel for the engine, said fuel detergent being added in an amount effective to reduce deposits and using said hydrocarbon fuel with fuel detergent additive as a fuel in an internal combustion engine.

15. A composition of matter comprising a detergent additive composition of claim 2 and a hydrocarbon fuel for an internal combustion engine.

16. A composition of matter comprising a detergent additive composition of claim 6 and a hydrocarbon fuel for an internal combustion engine.

17. A composition of matter comprising a detergent additive composition made by the method of claim 8 and a hydrocarbon fuel for an internal combustion engine.

18. A composition of matter comprising a detergent additive composition made by the method of claim 12 and a hydrocarbon fuel for an internal combustion engine.

19. A composition of claim 1 useful as a detergent additive for fuels comprising the reaction product prepared by reacting multiamine with aralkyl acid represented by RCOOH wherein R contains from about 11 to about 41 carbon atoms, said first product mixture further reacted with $SO_2$ to obtain a second product mixture.

20. A composition of claim 19 wherein the multiamines have the general formula $H_2N(CH_2CH_2NH)_xH$ where x is an integer between 1 and 10.

21. The composition of claim 19 wherein said R contains about 17 to about 29 carbon atoms.

22. A composition of claim 20 wherein the aralkyl acid is phenylstearic acid.

23. A composition of claim 22 wherein the multiamine is tetraethylenepentamine.

24. A method of claim 7 for producing a detergent additive composition useful in the treatment of fuels comprising: reacting multiamine with aralkyl acid represented by RCOOH wherein R contains from about 11 to about 41 carbon atoms, said first product mixture further reacted with $SO_2$ to obtain a second product mixture.

25. A method of claim 24 wherein the multiamines have the general formula $H_2N(CH_2CH_2NH)_xH$ where x is an integer between 1 and 10.

26. A method of claim 24 wherein said R contains about 17 to about 29 carbon atoms.

27. A method of claim 25 wherein said aralkyl acid is phenylstearic acid.

28. A method of claim 27 wherein the multiamine is tetraethylenepentamine.

29. A method for reducing engine deposits in an internal combustion engine comprising the addition of a detergent fuel additive package comprising the composition of claim 19 to a hydrocarbon fuel for the engine, said fuel detergent being added in an amount effective to reduce deposits and using said hydrocarbon fuel with fuel detergent additive as fuel in an internal combustion engine.

30. A method for reducing engine deposits in an internal combustion engine comprising the addition of a detergent fuel additive package comprising the detergent additive prepared by the method of claim 24 to a hydrocarbon fuel for the engine, said fuel detergent being added in an amount effective to reduce deposits and using said hydrocarbon fuel with fuel detergent additive as a fuel in an internal combustion engine.

31. A composition of matter comprising a detergent additive composition of claim 19 and a hydrocarbon fuel for an internal combustion engine.

32. A composition of matter comprising a detergent additive composition of claim 23 and a hydrocarbon fuel for an internal combustion engine.

33. A composition of matter comprising a detergent additive composition made by the method of claim 24 and a hydrocarbon fuel for an internal combustion engine.

34. A composition of matter comprising a detergent additive composition made by the method of claim 28 and a hydrocarbon fuel for an internal combustion engine.

35. A composition of claim 1 useful as a detergent additive for fuels comprising the reaction product prepared by reacting multiamine with tall oil acid said first product mixture further reacted with $SO_2$ to obtain a second product mixture.

36. A composition of claim 35 wherein the multiamines have the general formula $H_2N(CH_2CH_2NH)_xH$ where x is an integer between 1 and 10.

37. The composition of claim 35 wherein said tall oil acid comprising tall oil fatty acids in a range of about 50 to about 98 percent by weight of the total tall oil composition.

38. A composition of claim 37 wherein the multiamine is tetraethylenepentamine.

39. A method of claim 7 for producing a detergent additive composition useful in the treatment of fuels comprising: reacting multiamine with tall oil acid further reacting said first product mixture with $SO_2$ to obtain a second product mixture.

40. A method of claim 39 wherein the multiamines have the general formula $H_2N(CH_2CH_2NH)_xH$ where x is an integer between 1 and 10.

41. A method of claim 39 wherein said tall oil acid comprising tall oil fatty acids in a range of about 50 to about 98 percent by weight of the total tall oil composition.

42. A method of claim 41 wherein the multamine is tetraethylenepentamine.

43. A method for reducing engine deposits in an internal combustion engine comprising the addition of a detergent fuel additive package comprising the composition of claim 35 to a hydrocarbon fuel for the engine, said fuel detergent being added in an amount effective to reduce deposits and using said hydrocarbon fuel with fuel detergent additive as fuel in an internal combustion engine.

44. A method for reducing engine deposits in an internal combustion engine comprising the addition of a detergent fuel additive package comprising the detergent additive prepared by the method of claim 39 to a hydrocarbon fuel for the engine, said fuel detergent being added in an amount effective to reduce deposits and using said hydrocarbon fuel with fuel detergent additive as a fuel in an internal combustion engine.

45. A composition of matter comprising a detergent additive composition of claim 35 and a hydrocarbon fuel for an internal combustion engine.

46. A composition of matter comprising a detergent additive composition of claim 38 and a hydrocarbon fuel for an internal combustion engine.

47. A composition of matter comprising a detergent additive composition made by the method of claim 39 and a hydrocarbon fuel for an internal combustion engine.

48. A composition of matter comprising a detergent additive composition made by the method of claim 42 and a hydrocarbon fuel for an internal combustion engine.

* * * * *